US008591292B2

(12) United States Patent
Roscher

(10) Patent No.: US 8,591,292 B2
(45) Date of Patent: Nov. 26, 2013

(54) CEILING GRINDER

(75) Inventor: Kai Roscher, Niederpocking (DE)

(73) Assignee: Kai Roscher, Niederpocking (DE)

( * ) Notice: Subject to any disclaimer, the term of this patent is extended or adjusted under 35 U.S.C. 154(b) by 72 days.

(21) Appl. No.: 13/082,925

(22) Filed: Apr. 8, 2011

(65) Prior Publication Data

US 2011/0183587 A1 Jul. 28, 2011

Related U.S. Application Data

(63) Continuation of application No. PCT/EP2009/007860, filed on Nov. 3, 2009.

(51) Int. Cl.
*B24B 23/00* (2006.01)

(52) U.S. Cl.
USPC ..... 451/354; 451/353; 451/456

(58) Field of Classification Search
USPC ..... 451/353, 354, 359, 451–456
See application file for complete search history.

(56) References Cited

U.S. PATENT DOCUMENTS

| | | | | |
|---|---|---|---|---|
| 4,158,935 | A | 6/1979 | Robert | |
| 5,951,389 | A | 9/1999 | Hettes et al. | |
| 7,220,174 | B2 * | 5/2007 | Phillips et al. | 451/354 |
| 7,387,564 | B2 * | 6/2008 | Jespersen | 451/354 |
| 7,458,884 | B2 * | 12/2008 | Falk | 451/359 |
| 7,828,631 | B1 * | 11/2010 | Herbert | 451/344 |
| 2006/0073778 | A1 | 4/2006 | Phillips et al. | |

FOREIGN PATENT DOCUMENTS

| | | |
|---|---|---|
| DE | 202005011659 | 11/2005 |
| EP | 1 074 347 | 7/2000 |
| EP | 0 727 281 | 10/2001 |
| EP | 1 900 479 | 3/2008 |
| JP | 58192759 | 11/1983 |
| WO | 97/21521 | 6/1997 |
| WO | 2005053902 | 6/2005 |
| WO | 2007093874 | 8/2007 |

OTHER PUBLICATIONS

International Search Report (w/ English translation) issued by EPO for corresponding International Application No. PCT/EP2009/007860 with mail date of Feb. 18, 2010.
International Preliminary Report on Patentability (English translation) issued on May 10, 2011, by EPO for corresponding International Application No. PCT/EP2009/007860.

* cited by examiner

*Primary Examiner* — Dung Van Nguyen
(74) *Attorney, Agent, or Firm* — Myers Wolin, LLC

(57) ABSTRACT

A ceiling grinder comprising a drive unit, a grinding wheel, which can be set in rotation by means of the drive unit, a grinding head housing, which receives the grinding wheel and has an opening allowing the grinding wheel access to the surface to be ground and a holding element for holding the grinder. The ceiling grinder also has means for producing a negative pressure within the grinding head housing, by which the ceiling grinder is held on the surface to be ground, wherein the means for producing the negative pressure comprise lamellar elements, which rotate about the axis of the grinding wheel during the grinding operation of the ceiling grinder and thereby cause within the grinding head housing an air flow that induces a static negative pressure.

19 Claims, 7 Drawing Sheets

CEILING GRINDER

CROSS REFERENCE TO RELATED APPLICATIONS

The present application is a continuation of PCT/EP2009/007860 filed on Nov. 3, 2009, which claims priority to German Patent Application No. 10 2008 055 797.8, filed Nov. 4, 2008, the contents of each of which are incorporated herein by reference.

FIELD OF THE INVENTION

The present invention relates to a ceiling grinding machine, comprising a drive unit, a grinding plate, which can be set in rotation by means of the drive unit, a grinding-head housing receiving the grinding plate and having an opening giving the grinding plate access to the surface to be ground, and a holding element for holding the ceiling grinding machine.

BACKGROUND

Besides, such ceiling grinding machines, which are suitable for grinding not only a ceiling but also for grinding walls or other surfaces, are known in the most diverse embodiments from the prior art, for example from EP 0727281 B1. Such (ceiling) grinding machines, as is also the case, for example, of the grinding machine according to EP 0727281 B1, are frequently provided in the region of the grinding-head housing with a port for an air duct leading to a vacuum cleaner, in order to extract the air contaminated with grinding dust during the grinding operation out of the grinding-head housing.

Furthermore, from DE 202005011659 U1 there is known another grinding machine of the aforesaid type, in which, in addition to the aforesaid features, there are also provided means for generating a reduced pressure inside the grinding-head housing, so that the head part of the grinding machine, or the grinding machine—because of a force resulting from the reduced pressure—is pulled toward or held against the surface to be ground.

In this connection the hood surrounding the grinding plate therein is adjustable counter to a spring force and is equipped on its rim (pointing toward the surface to be ground) with an exchangeable slip ring, which is flush with the front side of the grinding plate during the grinding operation and thereby largely or completely seals the gap between the hood and the machined surface for a suction air flow. Hereby a reduced pressure can be generated inside the hood by means of a vacuum cleaner attached to the hood, so that the head part of the grinding machine is sucked to some degree against the wall or the ceiling and if necessary is held there against the force of its total weight. By virtue of the said means for generating reduced pressure, working with such a grinding machine is made much easier and less fatiguing for the operator, since hereby he no longer has to hold any of the weight or the total weight of the grinding machine above his head, especially during ceiling-grinding work.

Nevertheless, this machine also suffers from certain disadvantages.

In the first place, a grinding machine of such design, especially if the total weight of the grinding machine is to be held in this way against a ceiling, necessitates a particularly powerful vacuum device, which must still guarantee adequately high suction power to maintain operating safety even under difficult conditions (intense dust generation and correspondingly rapid fouling of dust filters inside the vacuum device). In the second place, the reduced pressure that can be generated inside the hood—and therefore the suction force that can be achieved against its contact face—is also dependent on adequate planarity of the surface to be ground, which in practice or in the specific application situation is not always the case. In the region of a (more or less) large irregularity of the surface to be ground, the gap between hood and surface to be machined can no longer be "largely" or "completely" sealed, whereby undesired ingress of air under the hood of the grinding head results. Hereby the reduced pressure generated by the vacuum cleaner can collapse immediately, and so the force pulling toward the surface to be ground suddenly disappears or is substantially reduced. The same problem may also occur due to operator errors, for example when the operator working with the grinding machine tilts the grinding head by a clumsy movement, whereby the reduced pressure previously prevailing in the hood suddenly collapses. The grinding machine, which at that moment may not be held adequately securely by the operator, may then separate from the ceiling (or wall) to be ground and—while the grinding plate is turning at high speed—drop to the floor, thus posing a considerable risk of injury for the operator or any other person in the vicinity. And, finally, the slip rings provided in the cited prior art are subject to rapid abrasive wear, which also leads to progressive deterioration of the necessary sealing or throttling effect of such a slip ring. Thus the slip rings must be frequently replaced in order to achieve the best possible reduced pressure.

And, finally, WO 2007/093874 A1 shows a floor grinding machine as well as a grinding disk provided therefor. The grinding disk is equipped on a mounting face turned toward the disk to be ground with a plurality of mutually independent grinding elements, which can be mounted detachably on the mounting face. However, the said floor grinding machine is not suitable for grinding ceilings, and beyond this it is neither described nor known that the said grinding elements are suitable for generating a reduced pressure.

SUMMARY

Starting from the prior art explained in the foregoing, the object of the present invention is to provide a ceiling grinding machine of the type mentioned in the introduction, which to some extent is held automatically against the surface to be ground and which functions as reliably as possible, is as independent as possible of the presence of a vacuum device or as independent as possible of the suction power of a suction device that may be additionally attached, and in which the disadvantages mentioned in the foregoing are reduced or do not even occur. Thus it is intended that a force acting on the grinding machine in the direction of the surface to be ground will already be achieved in particularly advantageous manner without the assistance of an optionally attachable vacuum cleaning device, or in other words with alternative means for this purpose.

Besides the features already mentioned in the introduction, this is characterized especially in that the means for generating the reduced pressure (reduced-pressure generating means) comprise lamellar elements, which rotate around the axis of the grinding plate during grinding operation of the grinding machine and thus cause an air flow that maintains a static reduced pressure inside the grinding head housing.

Consequently the lamellar elements provided according to the invention and the air flow generated hereby during grinding operation provide, for generation of reduced pressure, a new principle by which a (ceiling) grinding machine can be pulled counter to the force of its weight toward or completely held against a surface to be ground.

Particularly preferably the lamellar elements are so configured and so disposed on the grinding plate inside the grinding head housing that there, when the grinding plate is being driven, a steady air circulation is (also) established, contributing to a static reduced pressure of the desired magnitude or causing this on its own.

From "Bernoulli's law", which relates the static and dynamic pressure conditions to one another, and from which it can be deduced that (under the conditions also prevailing approximately here in any case) the sum of static and dynamic pressure is always constant, special importance is attached to the explanation of the reduced pressure (and the force resulting therefrom) established in connection with the present invention. After all, the air flow or air circulation induced by means of the lamellar elements inside the grinding-head housing (which during grinding operation is covered by the surface to be ground on the side corresponding to its opening) causes a high dynamic air pressure, and so—by applying the aforesaid constancy of the sum of static and dynamic air pressure—the static air pressure established inside the grinding-head housing is commensurately reduced compared with the air pressure outside the grinding-head housing. Since a certain (reduced) pressure is known to be equivalent to the force exerted thereby on a given surface, the (static) reduced pressure averaged over the area of the opening of the grinding-head housing, multiplied by precisely this area of the opening of the grinding-head housing, therefore corresponds, within the scope of the present invention, directly to the force acting on the grinding machine.

In a particularly preferred configuration of the invention, it is provided that the lamellar elements rotate together with the grinding plate around the axis thereof during grinding operation of the grinding machine.

Where it is mentioned in the foregoing that the lamellar elements functioning as means for generating reduced pressure rotate together with the grinding plate around the axis thereof, it is to be understood by this within the meaning of the invention that the lamellar elements (one-piece or multi-piece) are formed on the grinding plate or are appropriately fastened thereto (detachably or exchangeably if necessary) such that they rotate therewith.

As an alternative to this, however, it is also possible to provide that the lamellar elements are disposed on a support structure separate from the grinding plate and that this structure is set separately in rotation (for example, by means of a separate drive), in which case the rotation during grinding operation of the grinding machine may take place co-directionally or counter-directionally relative to the rotation of the grinding plate. For the purpose of the smallest possible weight of the inventive ceiling grinding machine, however, a common drive for the grinding plate and lamellar elements is to be preferred. In such a case, it may be advantageously provided within the scope of the invention that the lamellar elements are indeed set in rotation by the same drive unit as for the grinding plate, but the grinding plate and/or the lamellar elements (or a support structure supporting them) can be optionally coupled with or uncoupled from the drive unit—individually or together—via a switchable coupling mechanism, whereby, for example during startup of an inventive ceiling grinding machine, the lamellar elements generating a suitable reduced pressure can be set in rotation in a first step, while it is only in a second step, for example when the ceiling grinding machine is already in contact with the surface to be ground and is being held against it, can the grinding plate be turned on, or in other words also set in rotation. And, finally, it may also be advantageous, in order to intensify the static reduced pressure caused according to the invention, to provide that the lamellar elements are driven with a higher speed than is the grinding plate, as is possible, for example, by using a separate gear mechanism for the lamellar elements (wherein the transmission ratio is different from that of the gear mechanism for the grinding plate).

Compared with the already known prior art, the principle used here for generation of an air flow or air circulation—causing a static reduced pressure—inside the grinding-head housing by means of the lamellar elements that rotate or co-rotate with the grinding plate proves to be superior for several reasons:

First of all, it is to be pointed out in this connection that the means selected here for generation of reduced pressure are less dependent on any irregularities of the surface to be ground than is the case in the prior art. Specifically, in practical use of an inventive ceiling grinding machine, it has been found that the air circulation established according to the invention by means of the lamellar elements during grinding operation and causing the reduced pressure is established not only when the grinding housing surrounding the grinding plate already contacts the surface to be ground with its peripheral rim, but that the air circulation producing the reduced pressure within the meaning of the invention (in the case of correspondingly driven grinding plate with lamellar elements appropriately disposed thereon) is already established when the grinding-head housing is still at a certain distance (up to as much as several centimeters) from the surface to be ground. Besides, this is also true when the grinding head together with driven grinding plate is brought close to the ceiling but initially is not yet aligned exactly parallel with the ceiling—relative to the base surface of the grinding plate or the plane of the substantially circular opening of the grinding-head housing. Thus the grinding-head housing (provided the grinding plate together with the lamellas disposed thereon has been set in rotation) is already pulled toward the surface to be ground as it approaches this surface, and, starting from an orientation that at first is angled relative to the surface to be ground, also becomes automatically aligned parallel thereto.

The effect of establishment of a (steady) air circulation as early as the grinding head is approaching the surface to be ground can also be recognized in practice by the fact that (during use of a drive motor providing a particular output power) the speed of the grinding machine increases perceptibly as soon as the grinding-head housing with its opening giving access to the grinding plate is brought close to a bounding surface (to be ground). The (turbulent) air flow formerly generated—without boundary surface close to the opening—by the lamellas and the grinding plate then gives way to an air circulation that is partly self-sustaining and that demands less power from the drive motor than does the generation of the turbulent air flow (without adjacent bounding surface). This explains why the speed of the grinding plate increases in practice as the grinding head approaches a surface and it makes the generation of reduced pressure that already occurs in this condition plausible.

Thereby it also occurs that the reduced pressure achieved within the meaning of the invention by means of rotating lamellas and an air flow/air circulation induced thereby does not collapse (or does not diminish to the same extent as in the already known prior art) if additional air contact with the surrounding air develops, for example because of an irregularity of the ceiling in the region of the peripheral rim of the grinding-head housing. In this case also, therefore, the air flow or circulation induced by the lamellas and causing a reduced pressure is substantially maintained.

The reduced pressure generated according to the invention by means of the rotating lamellar elements as well as the force resulting therefrom and acting on the grinding head in the direction of the surface to be ground therefore proves to be much more stable with regard to a non-optimum orientation of the grinding-head housing relative to the surface to be ground or with regard to any irregularities in that surface than is the case in the prior art. This improves not only the operator safety but also the reliability and ease of use of the grinding machine.

Besides, it has been found that the air flow or circulation necessary for an appropriately strong pulling force is established even without a "slip ring" in the region of the opening of the grinding-head housing. Instead, it is sufficient, and also practical as regards preventing dust from being stirred up in the surroundings, for the grinding-head housing to be provided on its rim region facing the surface to be ground with a peripheral brush arrangement, which protects against dust but is as impervious as possible. Advantageously, it is therefore possible to dispense with a largely airtight connection between the surface to be ground and the grinding-head housing, whereby the frequent replacement of slip rings provided in the prior art for generation of reduced pressure can also be avoided.

Furthermore, the reduced pressure applied by the rotation of the lamellar elements and the force resulting therefrom on the grinding machine (or on its grinding head) are independent of the suction power of a vacuum cleaner attached, for example, for extraction of grinding dust or possibly additionally attached to the grinding-head housing.

The reduced pressure generated by the lamellar elements alone should therefore be—by suitable configuration and alignment of the lamellar elements that induce the air flow or circulation—as strong as possible, in order that it can already generate, with the rotating lamellar elements, a force that acts in the direction of the surface to be ground and that preferably corresponds to at least 60% or at least 80% of the force due to the weight of the entire ceiling grinding machine. The differential force that is then still necessary to hold the ceiling grinding machine against the ceiling to be ground can then be applied, for example, by additional reduced-pressure generation by the agency of additional reduced-pressure generating means (for example, an air-suction device appropriately connected via suitable air-conducting ducts to the grinding-head housing. These additional means—in contrast to the prior art—are then not required alone to apply the reduced pressure necessary to hold the grinding machine against the ceiling to be ground, and therefore are subject to (much) less stringent requirements as to their suction power.

In order to make full use of the advantage achievable according to the invention, however, it is provided in a first particularly preferred improvement of the present invention that the reduced pressure generated inside the grinding-head housing by the lamellar elements alone (or in other words without the possible boosting influence of an optionally attachable air-suction device) during grinding operation is so strong that the grinding machine is held against the surface to be ground with a force that exceeds the force due to the weight of the entire grinding machine. Thus failure or reduction of power of a vacuum cleaner connected in order to extract the grinding dust has no perceptible or no safety-relevant influence on the functioning of the grinding machine, including the force acting on it in the direction of the surface to be ground.

Inasmuch as it is repeatedly mentioned here that some of the said technical features are to be satisfied "in grinding operation" of the grinding machine, this obviously pertains to the operation of the grinding machine in a mode in which not only the grinding plate but also the lamellar elements are set in rotation, and specifically at a speed of the grinding plate or of the lamellar elements that is normal and can be supplied by the drive unit, and that (in the load situation) preferably extends into the range of at least 1000 revolutions per minute, advantageously into the range of 2000-3000 or even up to 5000 revolutions per minute. In principle, even higher speeds may be envisioned for strengthening the reduced pressure that can be generated by means of the lamellar elements provided according to the invention.

Nevertheless, in the case of attachment of a suitable suction device, as is optionally entirely possible and for reasons of steady removal of the grinding products is also to be preferred, by means of a port to be provided for this purpose on the grinding-head housing—preferably on the rear side—for connection of an (exhaust) air line, care must be taken that the air suction generated by the suction device does not detrimentally reduce the air flow or circulation generated by the lamellar elements and the reduced pressure resulting therefrom, but even advantageously further increases it.

If the reduced pressure induced by the lamellar elements as a result of their particular configuration and arrangement corresponds, for example, only to a force that is smaller than the total weight of the grinding machine, the additional reduced pressure necessary in the grinding-head housing to completely overcome the force due to the weight of the grinding machine must be applied by the suction device, and so, in such a case, different reduced-pressure generating means work together to hold the grinding machine against the ceiling.

A further preferred configuration of the present invention provides that the lamellar elements project axially toward the surface to be ground from an end face of the grinding plate and therefore form the grinding members of the ceiling grinding machine. This leads to spacing—which is present even in grinding operation—of the end face of the grinding plate from the surface disposed opposite it and to be ground. Hereby the grinding members projecting from the end face of the grinding plate within the foregoing meaning induce—even in the region of the grinding plate—an air flow circulating substantially around the axis of the grinding plate (between its base face and the surface to be ground) and thus an increase of the dynamic air pressure in this region also. In other words: The region of the grinding plate can contribute to generation of the necessary holding force for the grinding machine as a result of a static reduced pressure that is also established in the region, which was not the case for the reduced-pressure generating means known heretofore, since in their case the grinding plate with its grinding means disposed on it (for example, a grinding disk) was in contact over the entire area with the surface to be ground. Generation of reduced pressure with the previously known suction device was therefore limited, as regards the active area or the force to be exerted on the grinding machine, to the annular surface surrounding the grinding plate inside the hood of the grinding head.

The static reduced pressure developing within the meaning explained in the foregoing even in the region of the grinding plate, or in other words between the rotating grinding members, and the force that therefore acts in the direction of the surface to be ground then ensure—if the grinding plate is appropriately spring-mounted in the grinding-head housing—that a pulling force will simultaneously also act on the grinding plate in ceiling direction and thus the grinding force exerted on the ceiling (or the other surface to be ground) by the rotating grinding members will be increased.

In another expedient further improvement of the present invention, it is then additionally possible to provide that the lamellar elements are equipped, at least in their grinding region in contact with the surface to be ground, with an exchangeable grinding means, especially an abrasive paper, or are themselves fastened exchangeably to the grinding plate. Hereby it is ensured in particularly simple manner that the wearing grinding means can be renewed as needed—if necessary together with the lamellar elements.

Furthermore, it is particularly advantageous when the lamellar elements forming the grinding members are spring-mounted on the grinding plate relative to the axial direction of the grinding plate or are resilient by design. Hereby the contact pressure that the grinding members exert on the surface to be ground during grinding can be adjusted or influenced in particularly expedient manner.

In this connection (but not only then), it also proves to be particularly advantageous when a rim region of the grinding-head housing surrounding the opening for the grinding plate projects laterally beyond the grinding members in its non-operating position and is spring-mounted in such a way that, when the grinding-head housing is pressed counter to a spring force against the surface to be ground, it becomes deflected in such a way that the grinding members disposed on the grinding plate come into contact with the surface to be ground.

In yet another further improvement, it is preferably possible to provide that the spring-mounting of the grinding-head housing has a stop relative to the grinding plate, thus predetermining the maximum contact pressure that can be exerted on the surface to be ground by the grinding members, which in turn are resilient by design. Hereby—in connection with the force caused by the reduced-pressure generating means during grinding operation and exerted on the grinding plate and the entire grinding-head housing—the contact pressure that the grinding members exert counter to their resiliency when they are in (dynamic) contact with the surface to be ground is always constant and corresponding to the said maximum value.

Moreover, it is advantageous within the scope of the present invention when the lamellar elements extend in radial direction of the grinding plate, since hereby an appropriate air circulation within the meaning of the invention can be induced. In particular, if the lamellar elements project from the grinding plate in the direction of the surface to be ground in this case, it is then further advantageous if the grinding plate does not have any open through holes, at least in the intermediate region of the grinding members, or in other words in the annulus bounded by the radial extent of the lamellar elements, since this favors the establishment of a particularly effective air circulation between grinding plate and surface to be ground.

In contrast, a further advantageous embodiment of the present invention, in which it is not necessary to provide any lamellar elements that come into contact with the surface to be ground, is characterized in that the grinding plate has a plane grinding face with a plurality of through holes, wherein the through holes provide an air duct between the surface to be ground and the lamellar elements, which are disposed on the side corresponding to the non-grinding face.

In this exemplary embodiment of the invention, the through holes prove to be advantageous precisely in the respect that they respectively provide an air duct between the lamellar elements, which are disposed on the side corresponding to the non-grinding face, and the grinding face. The arrangement of the lamellar elements on the non-grinding face makes it possible to dispose them, for example, on the grinding plate on the back side of the grinding face or on a separate support structure, which does not form the grinding face of the ceiling grinding machine.

In this embodiment of the invention, the dynamic flow inducing the static reduced pressure acts in the region, among others, of the through holes of the grinding disk to the surface to be ground, whereby a suction effect within the meaning of the invention can be produced. In this connection it is of great advantage that there be provided here a grinding surface that is plane and is larger compared with the use of separate grinding elements. Furthermore, such a grinding plate can be manufactured more easily and the lamellar elements—with the exception of the air flow—are not exposed to any additional stress.

Within the scope of the present invention it is then particularly advantageous if the grinding plate is equipped in the region of its grinding face with a plane, exchangeable grinding means, especially in the form of an abrasive paper, which has cutouts corresponding to the through holes in the grinding face of the grinding plate, in order to create a suitable air duct between lamellar elements and the surface to be ground.

Such an exchangeable grinding means, especially in the form of an abrasive paper, can be manufactured particularly favorably, corresponds to the features, essential to the invention, of a particularly preferred exemplary embodiment of the present invention, and is therefore made the subject matter of an independent claim.

To achieve a suitable air flow or circulation, the lamellar elements of an inventive ceiling grinding machine are preferably angled relative to the grinding plate, or in other words relative to the end face of the grinding plate, which is oriented perpendicular to the axis of rotation, and, in fact, in particularly advantageous manner, at an angle of approximately 40°-65°.

The holding element is advantageously designed as a holding tube of telescopically adjustable length and is fastened to swivel on the grinding-head housing, thus positively influencing the ease of handling of an inventive ceiling grinding machine. With regard to another preferred further improvement of the present invention, if the drive unit is disposed in or on the grinding-head housing, it is advantageously possible for the electrical lead cable for the drive motor to be routed inside the hollow holding tube and, in fact, in spiral form—in order to ensure the telescopic adjustability thereof.

Furthermore, a hollow holding tube—in addition to its advantageously light weight—can be used simultaneously as the air guide for extraction of grinding dust and for this purpose can be connected at the end corresponding to the grinding head via a flexible air conduit to a matching port on the grinding-head housing, while at the end remote from the grinding-head housing it can be provided with a port for an air-extraction device, for example a connecting nozzle for attaching a vacuum cleaner. A handle mounted separately on the holding element or holding tube is preferably disposed securely thereon in a manner allowing it to be turned.

As the drive motor in an inventive grinding machine, there is preferably used a brushless electric motor designed as an external rotor and available in particularly compact and lightweight form despite having suitable power.

Finally, within the scope of the present invention, special attention is to be directed to the total weight of the inventive grinding machine, since ultimately it must be held against the surface to be ground by the reduced pressure generated by means of the "reduced-pressure generating means" and by the resulting force. It has been found that it is particularly advantageous when the total weight of the inventive (ceiling) grinding machine does not exceed three kilograms or—even more advantageously—two kilograms.

BRIEF DESCRIPTION OF THE DRAWINGS

Several exemplary embodiments of the present invention will be explained in more detail hereinafter on the basis of the drawing, wherein.

DETAILED DESCRIPTION

Figure 1:
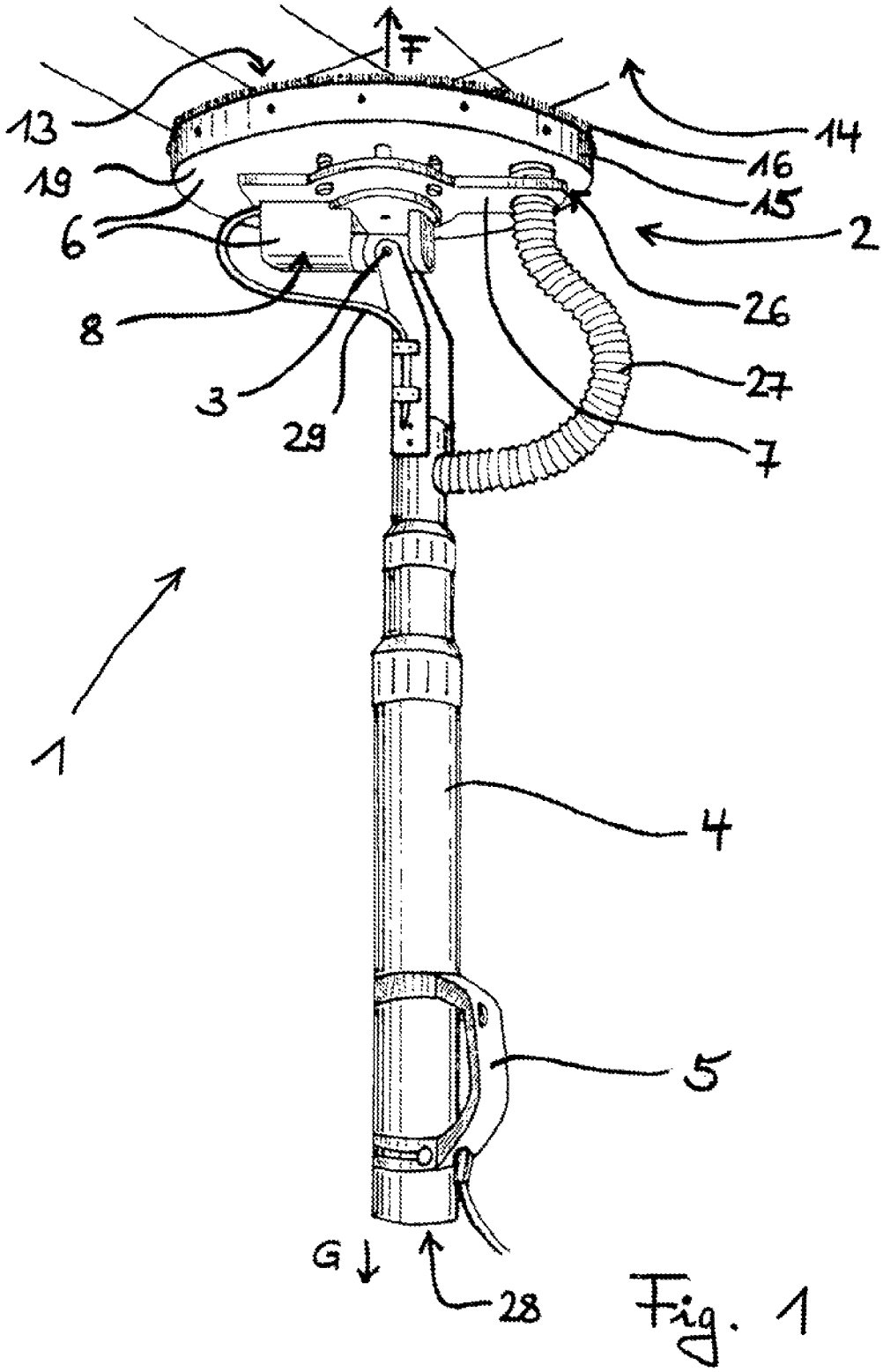
FIG. 1 shows a perspective view of the exemplary embodiment of an inventive ceiling grinding machine.
Figure 4:
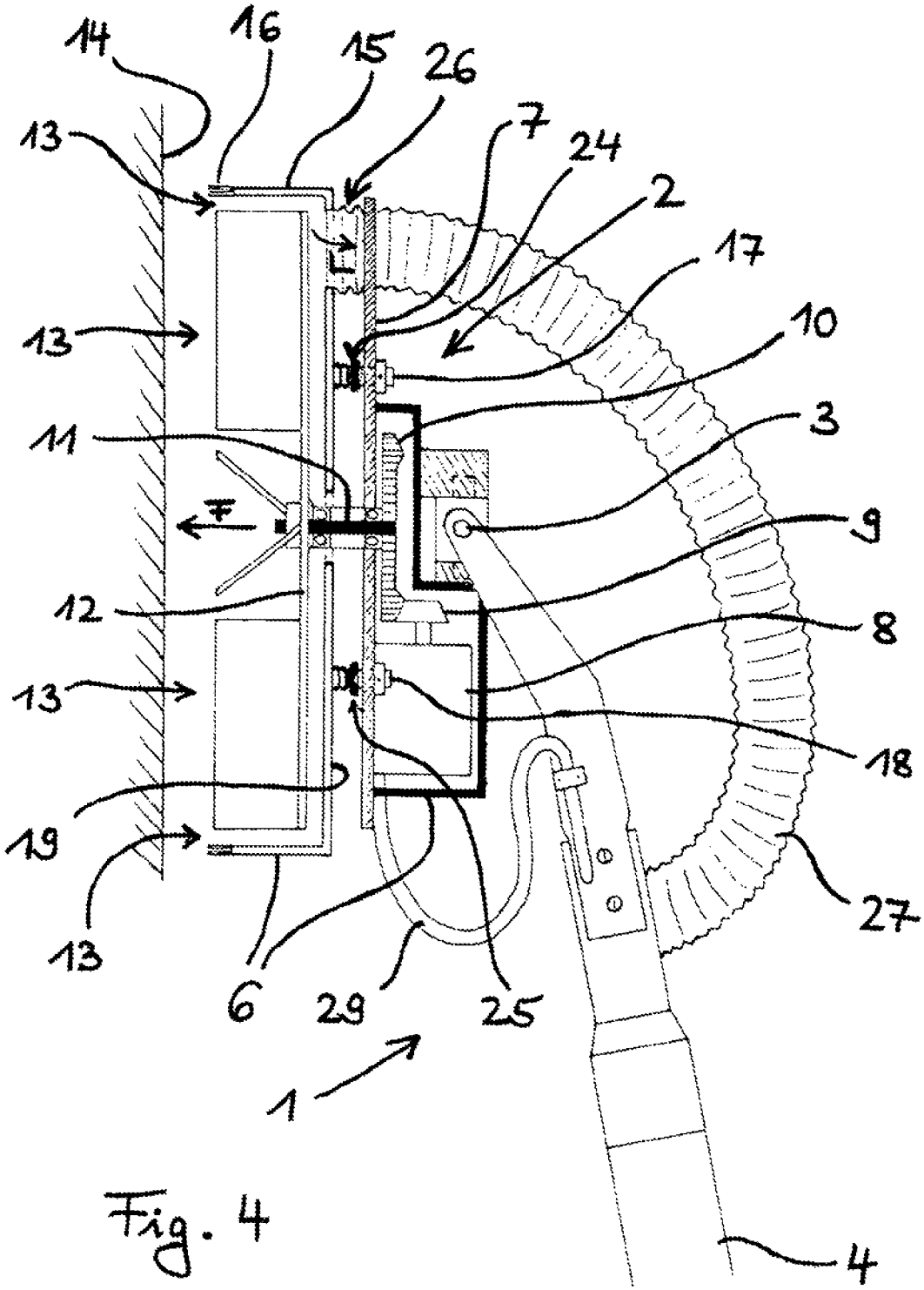
FIG. 4 shows a section through the inventive grinding machine of FIG. 1.

The exemplary embodiment of an inventive ceiling grinding machine 1 illustrated in FIGS. 1 and 4 in a perspective view as well as in a sectional diagram comprises a grinding head 2 and a holding element 4, which is fastened thereto by means of a link 3 to be swiveled around an axis and which has the form of a holding tube with a handle 5. Housing 6 of grinding head 2 comprises a mounting plate 7, on which there is mounted an electric drive motor 8, which in grinding operation functions as the drive unit together with a cone-gear mechanism, not illustrated in FIG. 1, of two cone gears 9, 10 meshing at 90° relative to one another and which sets grinding plate 12, which in FIG. 1 is hidden by grinding-head housing 6, in rotation via a spindle 11 fixed to rotate with grinding plate 12 and cone gear 10 at the end corresponding to the rotary plate. To ensure good rotary characteristics of rotary plate 12, spindle 11 is mounted on ball bearings supported by grinding-head housing 6.

Grinding-head housing 6 also has an opening 13, which points upward in FIG. 1 and to the left in FIG. 4, and which provides grinding plate 12 with access to a surface 14 to be ground, especially a ceiling or wall to be ground. This opening 13 is bounded by a rim 15, which surrounds grinding plate 12 and extends in the direction of surface 14, and which is closed at its end facing surface 14 to be ground by a peripheral brush arrangement 16. This is used in particular as dust protection for the surroundings, since otherwise the grinding dust produced during grinding operation could be discharged into the surroundings because of the air flow or circulation prevailing inside the grinding-head housing.

Grinding-head housing 6, which surrounds grinding plate 12 substantially completely (with the exception of the region of opening 13), further comprises a grinding-head housing part 19, which is spring-mounted on mounting plate 7 via suitable studs 17, 18, and which forms the actual seat for grinding plate 12, which is disposed in fixed position relative to support plate 7 (with the exception of its ability to rotate). By virtue of the spring-mounting of housing part 19, grinding plate 12 and rim 15 of the grinding-head housing surrounding grinding plate 12 are adjustable in their relative positions.

Figure 2:
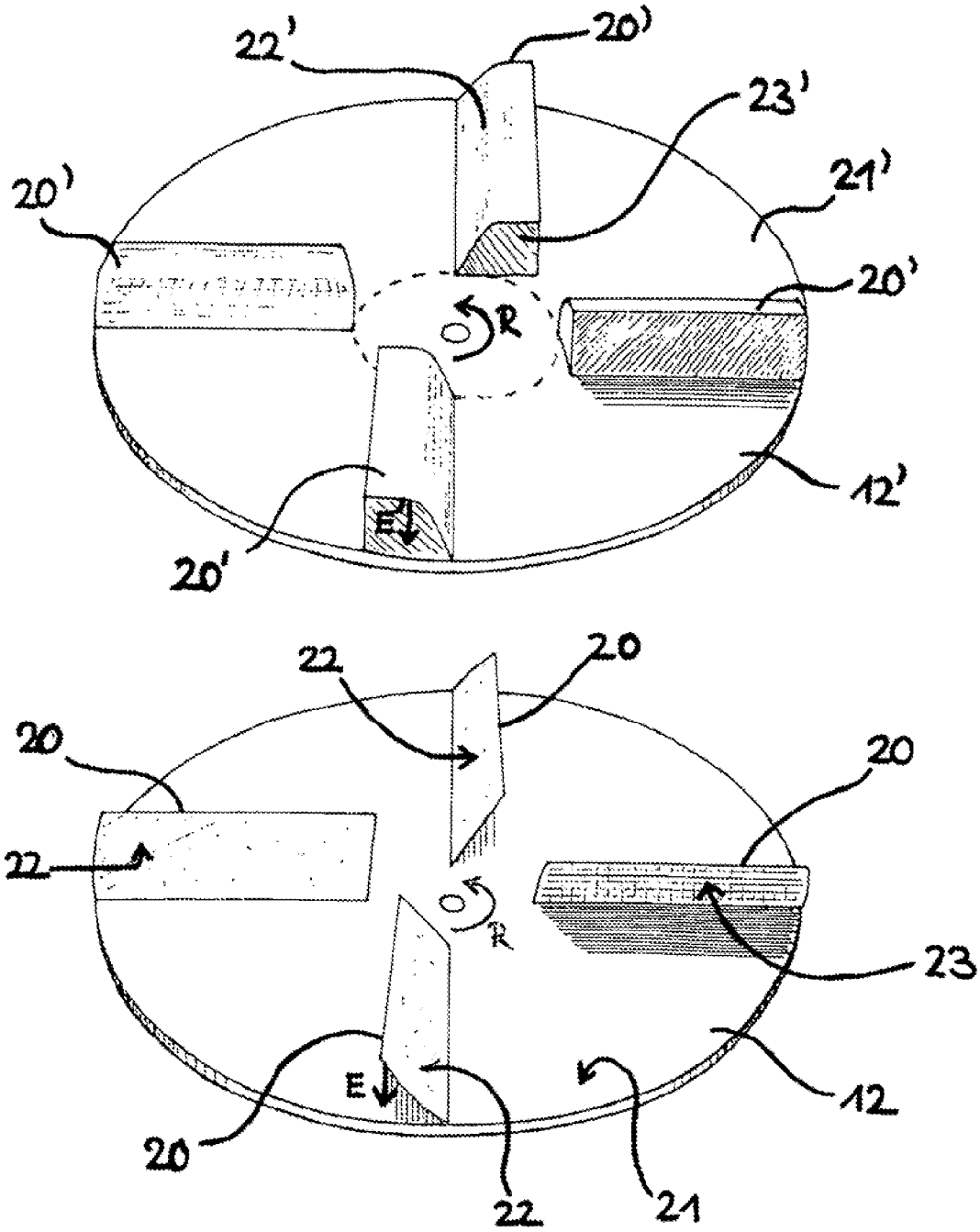
FIG. 2 shows two grinding plates equipped with lamellar elements for use in the grinding machine of FIG. 1.
Figure 3:
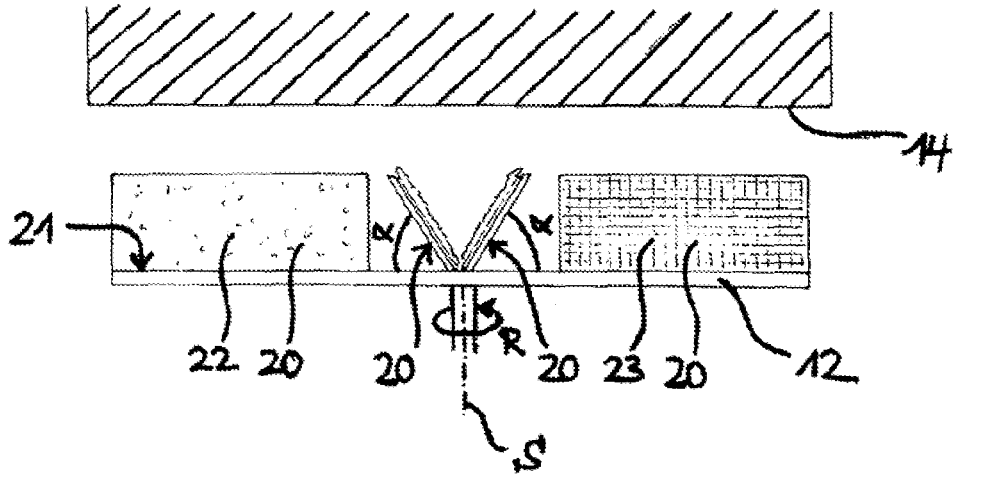
FIG. 3 shows the grinding plate of FIG. 2 (bottom) without and with contact with the surface to be ground.
Figure 3:
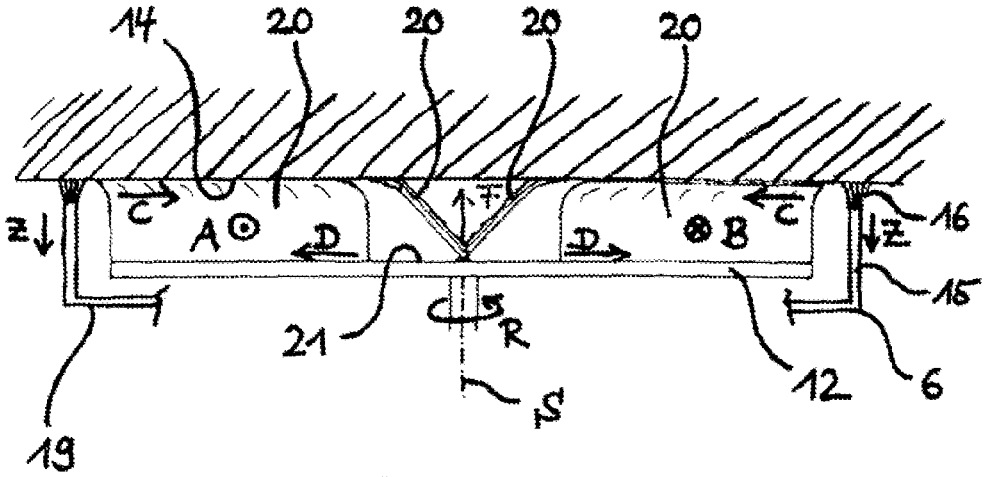

On end face 21 of grinding plate 12, which is shown in FIG. 4 and illustrated in FIG. 2 (bottom) and in even more detail in FIG. 3 and which points toward surface 14, there are fastened, in total, in such a way as to rotate therewith, four lamellar elements 20, which project axially from the said end face 21 of grinding plate 12, extend respectively in radial direction on the grinding plate and are distributed uniformly, or in other words at respective intervals of 90° here, over the periphery of grinding plate 12. Obviously it is also possible to provide a larger number (such as five, six, seven or even more) or a smaller number (such as three or even only two) of lamellar elements 20.

In the present exemplary embodiment of the invention, lamellas 20 are simultaneously used as grinding members, and so end face 21 of grinding plate 12 pointing toward surface 14 is spaced apart from surface 14 during the actual grinding operation. To ensure that lamellar elements 20, which are preferably manufactured from a robust carbon fiber material 23 having a certain flexibility, can fulfill the grinding function for which they are intended, they are coated on their front side pointing in direction of rotation R with a grinding means 22 in the form of a particularly robust abrasive paper, which can be fastened in appropriate manner (exchangeably) on lamellar elements 20. As an alternative to this, lamellar elements 20 may also be fastened exchangeably on grinding plate 12 or even the entire grinding plate 12 can be designed to be exchangeable. Besides, lamellas 20 may also be manufactured from other materials, such as plastic or light metal, and by virtue of the chosen materials and of their inclined position (angle alpha, see FIG. 3 top) relative to end face 21 of grinding plate 12, they may have a certain resiliency, so that, for example, depending on their contact pressure on surface 14 to be ground, they can be bent within certain limits toward the grinding plate as shown by arrow E.

Besides, the second grinding plate, which is illustrated at the top of FIG. 2 and on which four lamellar elements 20', again functioning as grinding members, are also fastened in similar manner and arrangement, has comparable properties. In this case the grinding members consist of an approximately wedge-shaped base member 23' of an elastic foamed material, which is again equipped with a robust abrasive paper 22' on its front side pointing in direction of rotation R and its top side pointing toward the wall or ceiling. Here also elasticity (see arrow E') comparable to that of the exemplary embodiment explained hereinabove exists. Furthermore, grinding plate 12 or 12' does not have through holes in the region of an annulus, which is bounded inwardly by the circle shown as a dashed line and outwardly by the periphery of the grinding plate.

Referring to FIGS. 3 and 4, it can now be explained on the example of the grinding plate shown at the bottom of FIG. 2 how a reduced pressure in grinding-head housing 6 and a resulting force F on grinding head 2 are produced inside grinding-head housing 6 (illustrated only partly in FIG. 3) by means of lamellar elements 20.

The lamellas or grinding members 20 rotating around axis of rotation S of grinding plate 12 in the direction of arrow R can still rotate substantially freely with the grinding plate in the top diagram of FIG. 3, in which the grinding machine is still at a certain distance from surface 14 to be ground, whereas in the bottom diagram of FIG. 3, which shows the actual grinding operation, they are in frictional contact with surface 14 to be ground. Consequently, at preferred speeds under load of approximately 2000 to 3000 revolutions per minute (or higher), they scoop the air present in the grinding-head housing between the surface to be ground and the rotary plate in the direction of arrows A and B, pointing out of or into the plane of the drawing, thus leading, by virtue of the rotation of grinding plate 12 together with lamellas 20, to a circular flow rotating substantially around axis S inside the grinding-head housing (between grinding plate 12 and ceiling 14 to be ground).

A further effect is obtained on the basis of the centrifugal force acting on the air in the vicinity of the grinding plate, which force causes an air flow directed radially outward according to arrow D there, or in other words directly above end face 21 of grinding plate 12 pointing toward surface 14, between each two neighboring lamellas 20. Since the air drawn substantially from the middle of the grinding plate for this purpose must be replaced there in some other way, an air flow directed radially inward according to arrow C, then bending off in the direction of grinding plate 12 at the middle of the grinding plate, where it is again transported outward according to arrow D, is established in the direct vicinity of surface 14 to be ground. Superposed on these two air flows, there is established an air circulation that rotates substantially around central axis S, spreads radially outward on a somewhat spiral path in the vicinity of the grinding plate and travels radially inward on a spiral path in the vicinity of the ceiling or wall. This air circulation or air flow induced by means of drive unit 8 and lamellar elements 20 generates a high dynamic air pressure and thus a commensurately decreased static air pressure inside grinding-head housing 6, whereby the entire grinding head 2 (even above grinding plate 12 fastened in axial direction to mounting plate 7) is pulled with a force according to arrow F in the direction of the surface to be ground. If this force F exceeds the total weight G (see FIG. 1) of the grinding machine, this will be held against the ceiling during grinding operation, as is intended within the meaning of the invention.

The air-flow conditions explained in the foregoing are already substantially established when grinding head 2 (together with rotating grinding plate 12) approaches the ceiling or another surface 14 to be ground, even when it is not yet in contact with the surface via its rim 15 or with brush arrangement 16 disposed thereon. Besides, force F acting on the grinding plate then also ensures that grinding-head housing 19, which projects ahead of grinding members 20 with its brush arrangement 16 and which is spring-mounted on mounting plate 7, is positioned counter to the spring force according to arrow Z, whereby a greater contact pressure, manifested by elastic deformation of grinding members 20 (see FIG. 3 bottom), is exerted on grinding members 20. If this positioning ability is now limited by means of suitable stop elements 24, 25, a well-defined contact pressure of (elastic or spring-mounted) grinding members 20 on surface 14 to be ground is established in grinding operation.

Also provided on grinding-head housing 6 is a port 26 for an air hose 27, which at the end corresponding to the grinding head is in air-conducting communication with hollow handle tube 4, on which—at the opposite end—there is provided a further port 28 for a (commercial) vacuum cleaner for extracting grinding dust. Thus air contaminated with grinding dust can be extracted from grinding-head housing 6 according to arrow L (see FIG. 4), if necessary in conjunction with additional generation of reduced pressure inside grinding-head housing 6 and accordingly with an increase of the force F holding grinding machine 1 against a surface to be ground.

Figure 5:
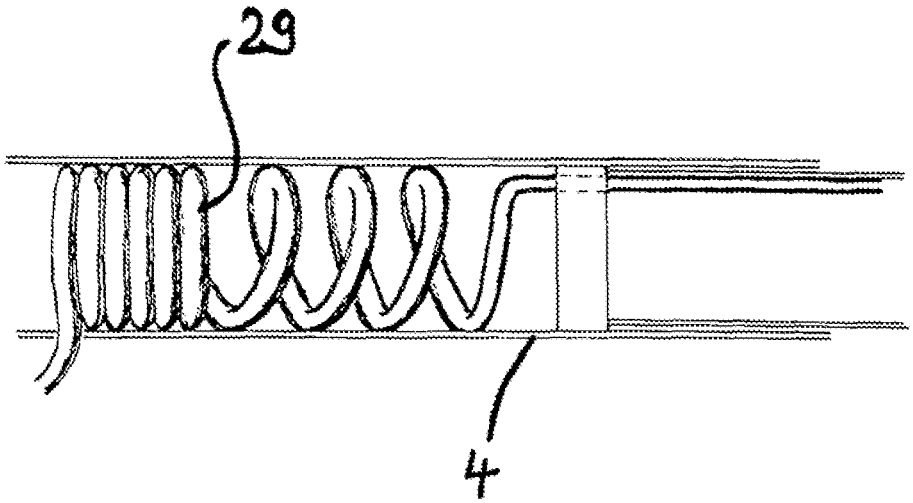
FIG. 5 shows two detail views of the cable routing in the holding tube and of the arrangement of the handle.
Figure 5:
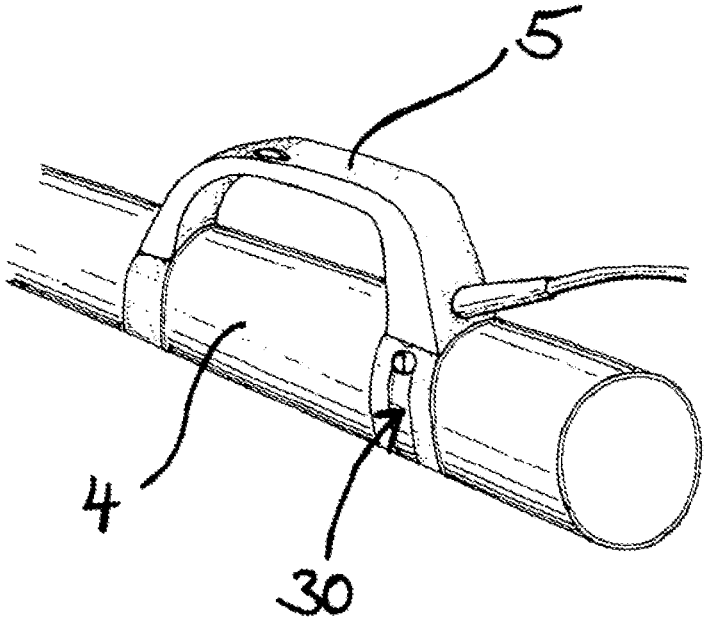

Electric cable 29 supplying drive motor 8 with current is also routed at the end corresponding to the grinding head into hollow holding tube 4, where it is routed as a spiral cable, as illustrated in FIG. 5 top, in order not to impair the ability of holding tube 4 to change length telescopically.

Finally, FIG. 5 bottom further shows the specific configuration of handle 5, which is disposed on holding tube 4 and which can be turned relative to the holding tube by using an elongated hole 30 extending in circumferential direction.

Figure 6:
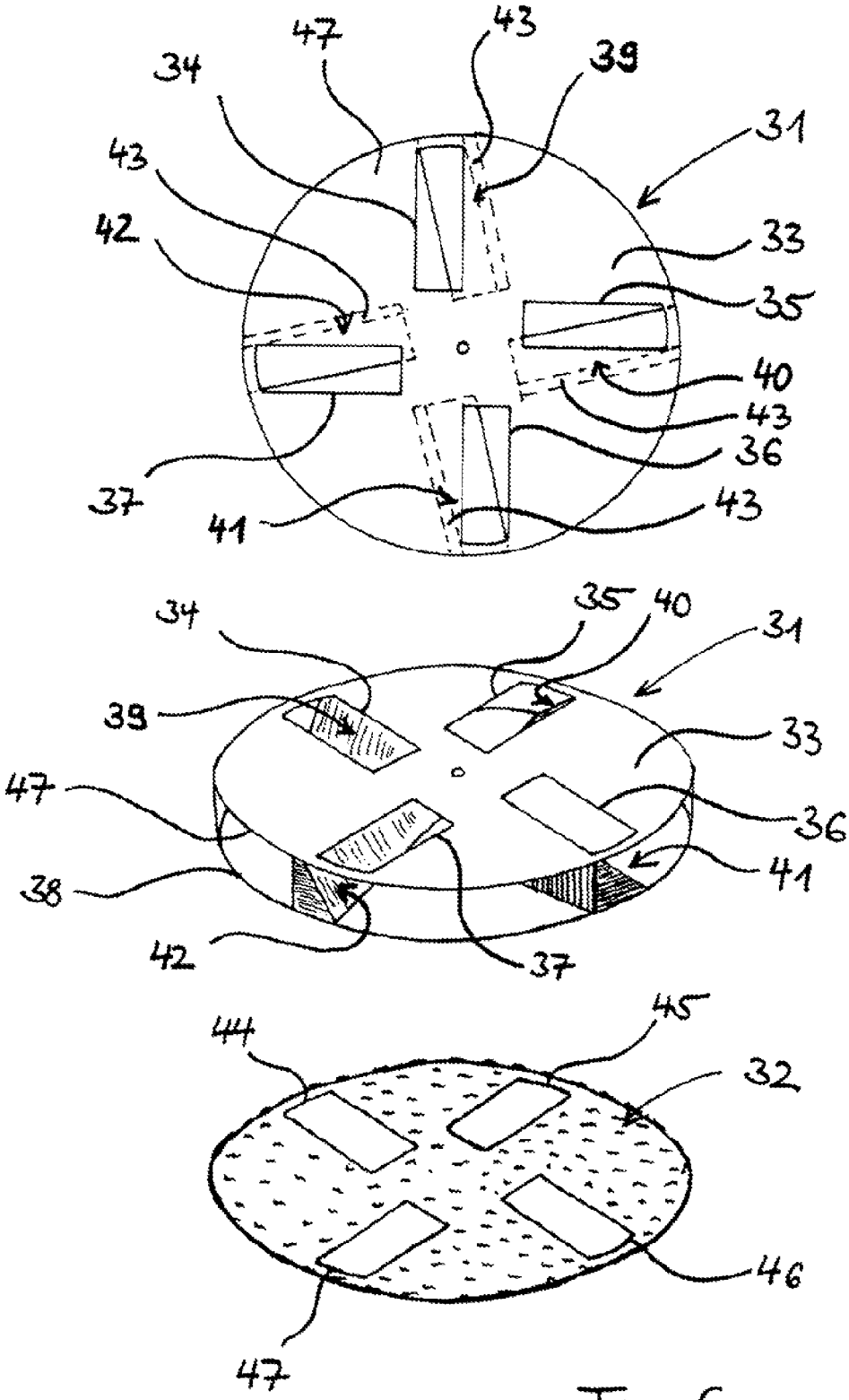
FIG. 6 shows a further exemplary embodiment of a grinding plate for use in a ceiling grinding machine according to FIG. 1 with lamellar elements disposed on the back side of the grinding face in two different views, as well as a grinding means suitable therefor.

In three views disposed one above the other, FIG. 6 shows—from top to bottom—first an overhead view of a further grinding plate 31 for use in a grinding machine according to FIG. 1, then a perspective view of grinding plate 31 in question and finally a grinding means 32, which has the form of an abrasive paper and which can be fastened exchangeably on grinding face 33 of grinding plate 31 in question.

Grinding plate 31 has a grinding face 33, which in FIG. 6 points upward, which is formed by a first substantially or exactly circular disk 47 of grinding plate 31 and which is provided with a total of four—substantially rectangular—through holes 34-37. Through holes 34-37 extend in their longitudinal direction—in a manner comparable to the grinding elements of the foregoing exemplary embodiments—substantially in radial direction and respectively provide an air duct for each of the total of four lamellar elements 39-42. Experiments have shown that an air flow capable of holding the grinding machine against the ceiling to be ground—at suitably high speed and suitably low weight of the ceiling grinding machine in total—can be generated even with this configuration of grinding plate 31.

Lamellar elements 39-42 are formed by the obliquely angled front face of four substantially wedge-shaped elements, which are disposed between first disk 47 and a second disk 38 disposed parallel thereto and—viewed from above—are positioned slightly offset relative to through holes 34-37. On the top side, each wedge-shaped element has a flat web 43, with which it bears against the back side of the grinding face of first disk 47.

At the bottom of FIG. 6 there is also shown another—substantially or exactly round and plane—abrasive paper 32 for fastening exchangeably on grinding plate 31 on the side corresponding to the grinding face, which paper has a total of four cutouts 44-47, which correspond to through holes 34-37 of grinding face 33 of grinding plate 31.

Figure 7:
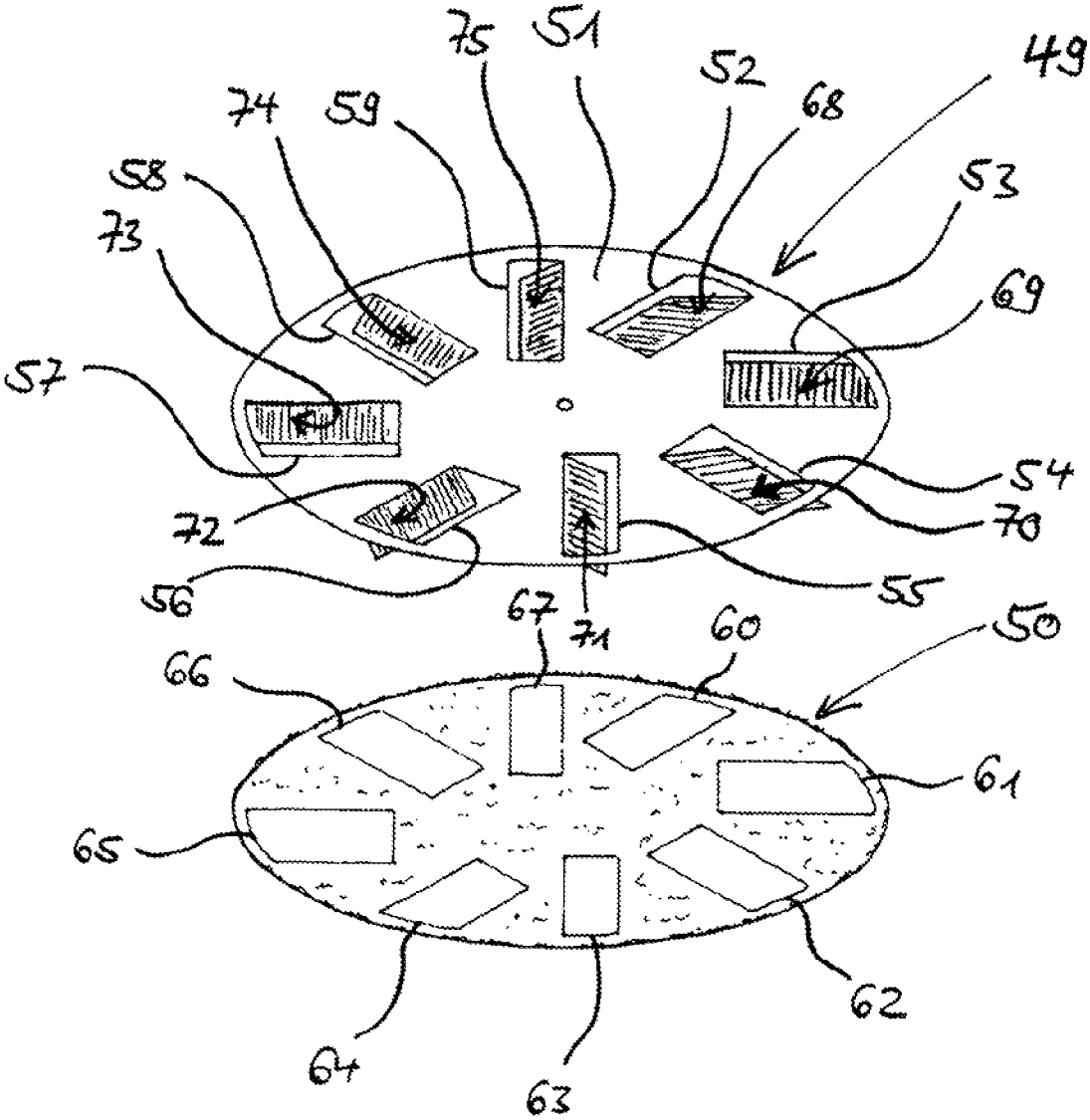
FIG. 7 shows yet another alternative exemplary embodiment of a grinding plate for use in a ceiling grinding machine according to FIG. 1 with associated grinding means.

Finally, FIG. 7 shows, in a perspective view (diagram in FIG. 7 top), one last exemplary embodiment of a grinding plate 49 that can be used within the scope of the invention, together with associated abrasive paper 50 (diagram in FIG. 7 bottom). Here, grinding face 51 of grinding plate 49, which in the present case is manufactured from only one disk in total, has a total of eight through holes 52-59, with which there are associated corresponding cutouts 60-67 of abrasive paper 50. Moreover, lamellar elements 68-75, which are formed in one piece with grinding disk 49 and project there obliquely from the back side of the grinding face, are disposed at each through hole of grinding disk 51.

Such a grinding plate 49 may be made, for example, from aluminum, by punching out through holes 52-59 along three edges in an aluminum disk then bending into the illustrated position to form lamellar elements 68-75.

I claim:

1. A ceiling grinding machine (1) comprising:

a drive unit (8, 9, 10), a grinding plate (12, 12'; 31; 49), which can be set in rotation by means of the drive unit (8, 9, 10), a grinding-head housing (6) receiving the grinding plate (12, 12'; 31; 49) and having an opening (13) giving the grinding plate (12, 12'; 31; 49) access to a surface (14) to be ground, and a holding element (5) for holding the grinding machine (1), the ceiling grinding machine (1) further comprising means for generating a reduced pressure inside the grinding-head housing (6) so that the ceiling grinding machine (1)

is held against the surface (14) to be ground, the means for generating the reduced pressure comprising lamellar elements (20, 20'; 39-42; 68-75) that rotate (arrow R) around an axis (S) of the grinding plate (12, 12'; 31; 49) during grinding operation of the ceiling grinding machine (1) and cause an air flow (arrows A, B, C, D) that induces a static reduced pressure inside the grinding head housing (6), wherein the reduced pressure generated by the lamellar elements alone genrates a force which acts in the direction of the surface to be ground and which corresponds to at least 60% of the weight of the entire ceiling grinding machine.

2. A ceiling grinding machine according to claim 1, wherein the lamellar elements (20, 20'; 39-42; 68-75) rotate together with the grinding plate (12, 12'; 31; 49) around the axis (S) thereof during grinding operation of the grinding machine (1).

3. A ceiling grinding machine according to claim 1, wherein the reduced pressure generated inside the grinding-head housing (6) by the lamellar elements (20, 20'; 39-42; 68-75) alone during grinding operation is so strong that the grinding machine (1) is held against the surface (14) to be ground with a force (F) that exceeds the force (G) due to the weight of the entire ceiling grinding machine (1).

4. A ceiling grinding machine according to claim 1, wherein a port (26) for an air-conducting line (27) of a suction device is provided on the grinding-head housing (6).

5. A ceiling grinding machine according to claim 1, wherein the lamellar elements (20, 20') project axially toward the surface (14) to be ground from an end face (21, 21') of the grinding plate (12, 12') and form the grinding members of the grinding machine (1).

6. A ceiling grinding machine according to claim 5, wherein the lamellar elements (20, 20') are equipped, at least in their grinding region in contact with the surface (14) to be ground, with an exchangeable grinding means (22, 22'), or are fastened exchangeably to the grinding plate (12, 12').

7. A ceiling grinding machine according to claim 5, wherein the lamellar elements (20, 20') forming the grinding members are spring-mounted on the grinding plate (12, 12') relative to the axis (S) of the grinding plate (12, 12') or are resilient by design.

8. A ceiling grinding machine according to claim 7, wherein the spring-mounting of the grinding-head housing (6, 19) has a stop (24, 25) relative to the grinding plate (12, 12'), thus predetermining the maximum contact pressure that can be exerted on the surface (14) to be ground by the grinding members (20, 20'), which in turn are resilient by design.

9. A ceiling grinding machine according to claim 1, wherein a rim region (15) of the grinding-head housing (6) surrounding the opening (13) for the grinding plate (12, 12') projects laterally beyond the grinding members (20, 20') in its non-operating position and is spring-mounted in such a way that, when the grinding-head housing (6, 19) is pressed counter to a spring force against the surface (14) to be ground, it becomes deflected in such a way that the grinding members (20, 20') disposed on the grinding plate (12, 12') come into contact with the surface (14) to be ground.

10. A ceiling grinding machine according to claim 1, wherein the lamellar elements (20, 20') extend in radial direction of the grinding plate (12, 12').

11. A ceiling grinding machine according to claim 10, wherein the grinding plate (12, 12') does not have any open through holes in the annulus bounded by the radial extent of the lamellar elements (20, 20').

12. A ceiling grinding machine according to claim 10, wherein the grinding plate (31, 49) is equipped in the region of its grinding face with a plane, exchangeable grinding means (32, 50), especially in the form of an abrasive paper (32, 50), which has cutouts (44-47; 60-67) corresponding to the through holes (34-37; 52-59) in the grinding face (33, 51) of the grinding plate (31, 49).

13. A ceiling grinding machine according to claim 1, wherein the grinding plate (31, 49) has a plane grinding face (33, 51) with a plurality of through holes (34-37; 52-59), wherein the through holes (34-37; 52-59) provide an air duct between the surface to be ground and the lamellar elements (39-42; 68-75), which are disposed on the side corresponding to the non-grinding face.

14. A grinding machine according to claim 13, further comprising a grinding means, wherein the grinding means (32, 50) is a plane and has a plurality of cutouts (44-47; 60-67), each of which gives access to a through hole (34-37; 52-59) of the grinding face (33, 51) of the grinding plate (31, 49) or to the air duct created thereby to the lamellar elements (39-42; 68-75).

15. A ceiling grinding machine according to claim 1, wherein the lamellar elements (20, 20') are oriented at an angle (alpha) of approximately 40°-65° relative to the grinding plate (12, 12').

16. A ceiling grinding machine according to claim 15, wherein the drive unit (8, 9, 10) comprises a brushless electric motor (8) designed as an external rotor.

17. A ceiling grinding machine according to claim 1, wherein the holding element (4) is designed as a holding tube of telescopically adjustable length and is fastened to swivel on the grinding-head housing (6).

18. A ceiling grinding machine according to claim 1, wherein the drive unit (8, 9, 10) is disposed in or on the grinding-head housing (6).

19. A ceiling grinding machine according to claim 1, wherein the grinding machine (1) does not exceed a total weight of three kilograms.

* * * * *